US011081038B1

(12) United States Patent
Lin et al.

(10) Patent No.: US 11,081,038 B1
(45) Date of Patent: Aug. 3, 2021

(54) DATA DRIVING CIRCUIT AND DISPLAY APPARATUS FOR ADVOIDING DATA LINES BEING OVERCHARGED

(71) Applicant: Hefei Jadard Technology Co., Ltd., Hefei (CN)

(72) Inventors: Liang-Hong Lin, Hefei (CN); Tai-An Chen, Hefei (CN); Qing-Shan Yan, Shenzhen (CN)

(73) Assignee: Hefei Jadard Technology Co., Ltd., Hefei (CN)

( * ) Notice: Subject to any disclaimer, the term of this patent is extended or adjusted under 35 U.S.C. 154(b) by 0 days.

(21) Appl. No.: 17/098,664

(22) Filed: Nov. 16, 2020

(30) Foreign Application Priority Data

Sep. 30, 2020 (CN) ..... 202011062824.3

(51) Int. Cl.
*G09G 3/20* (2006.01)

(52) U.S. Cl.
CPC ..... *G09G 3/20* (2013.01); *G09G 2310/027* (2013.01); *G09G 2310/0267* (2013.01); *G09G 2310/0286* (2013.01); *G09G 2310/0289* (2013.01); *G09G 2310/08* (2013.01)

(58) Field of Classification Search
CPC ..... G09G 2310/08; G09G 2310/0289; G09G 2310/0267; G09G 3/20; G09G 2310/0286; G09G 2310/027
See application file for complete search history.

(56) References Cited

U.S. PATENT DOCUMENTS 6,664,943 B1 * 12/2003 Nakajima ..... G09G 3/2011 345/100
7,812,804 B2 * 10/2010 Hashimoto ..... G09G 3/3688 345/95
2010/0321413 A1 * 12/2010 Weng ..... G09G 3/3688 345/690

* cited by examiner

*Primary Examiner* — Muhammad N Edun
(74) *Attorney, Agent, or Firm* — ScienBiziP, P.C.

(57) ABSTRACT

A data driving circuit proofed against excessive pixel brightness because of overvoltage on the data line comprises a shift register circuit, a first latch circuit, a second latch circuit, a level shift circuit, a DAC circuit, and an output circuit. The second latch circuit detects a change in the MSB of the data signal of a sampled signal, and outputs a signal for applying a pre-operation of the current data line. When the MSB of the sampled signal is changed, the second latch circuit outputs a pre-operation enabling signal, and whether the grayscale value of the current data line is within a specified region. If within the specified region, the second latch circuit outputs an invalid signal, and the pre-operation is disabled.

14 Claims, 6 Drawing Sheets

DATA DRIVING CIRCUIT AND DISPLAY APPARATUS FOR ADVOIDING DATA LINES BEING OVERCHARGED

FIELD OF THE INVENTION

The subject matter herein generally relates to displays, particularly a data driving circuit and a display apparatus.

BACKGROUND

Displays are widely used in electronic device as a touch-input and output device. Each display includes a display panel and a display driving circuit. The display panel includes a plurality of pixels. The display driving circuit includes a time controller, a scan driving circuit, and a data driving circuit. The data driving circuit converts n bits of a digital signal into a driving voltage to the pixels. The data driving circuit includes a shift register, a first latch, a second latch, a level shift circuit, a digital-to-analog converter (DAC) circuit, and an output circuit. The second latch detects a most significant bit (MSB) of a sampled signal generated by the first latch. When the MSB of the sampled signal is changed, the DAC circuit pre-charges or pre-discharges a corresponding data line according to a specified voltage. In the pre-charging operation, the driving voltage of the data line may be more than a target voltage, thus the data line is overcharged, which causes the corresponding display region to be brighter, thus a display of the display device is affected.

There is room for improvement in the art.

BRIEF DESCRIPTION OF THE FIGURES

Implementations of the present disclosure will now be described, by way of example only, with reference to the attached figures.

DETAILED DESCRIPTION

Figure 1:
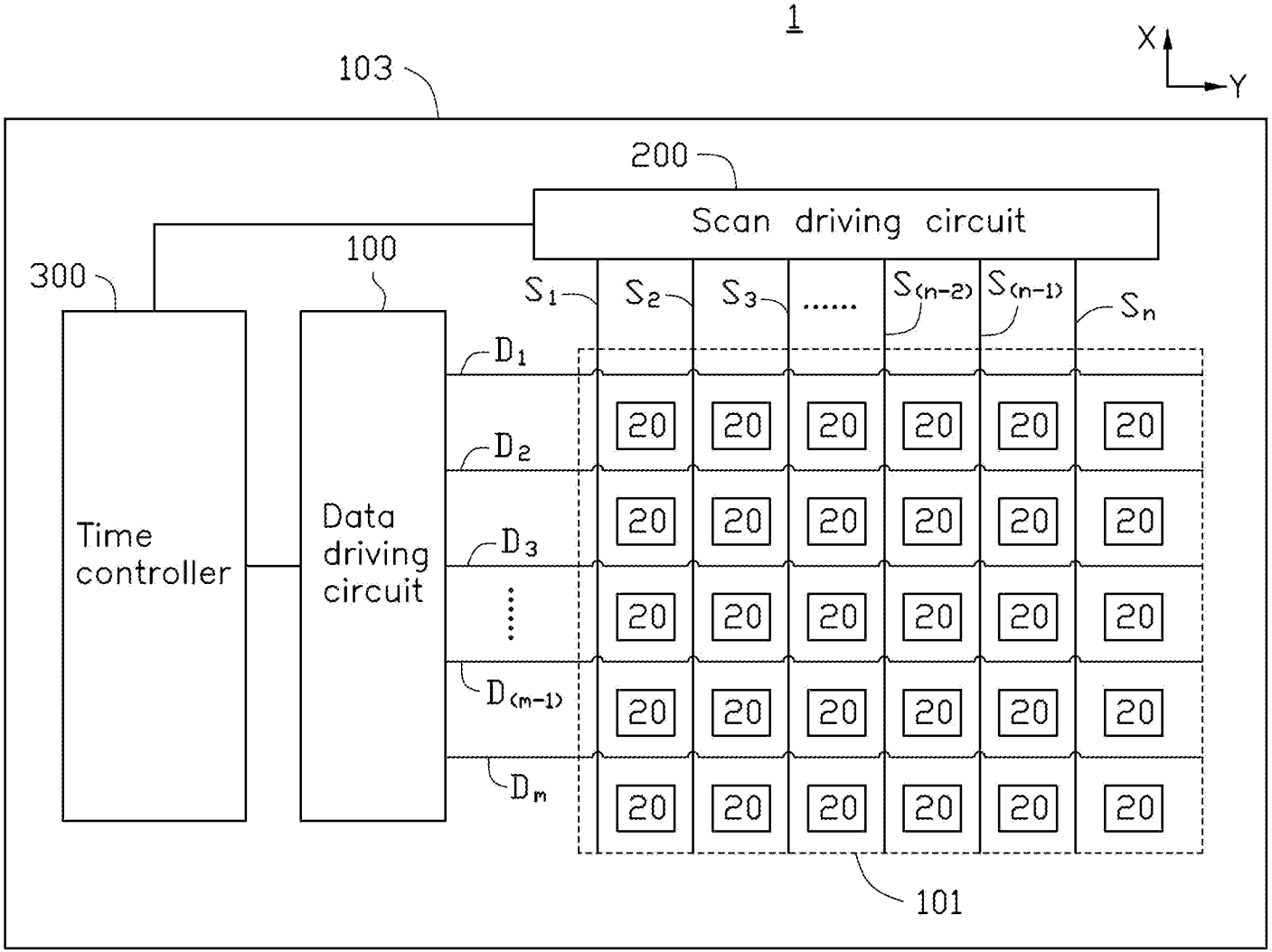
FIG. 1 is a diagram illustrating an embodiment of a display apparatus.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

In general, the word "module," as used herein, refers to logic embodied in hardware or firmware, or to a collection of software instructions, written in a programming language, for example, Java, C, or assembly. One or more software instructions in the modules may be embedded in firmware, such as an EPROM, magnetic, or optical drives. It will be appreciated that modules may comprise connected logic units, such as gates and flip-flops, and may comprise programmable units, such as programmable gate arrays or processors, such as a CPU. The modules described herein may be implemented as either software and/or hardware modules and may be stored in any type of computer-readable medium or other computer storage systems. The term "comprising" means "including, but not necessarily limited to"; it specifically indicates open-ended inclusion or membership in a so-described combination, group, series, and the like. The term "circuit" is defined as an integrated circuit (IC) with a plurality of electronic elements, such as capacitors, resistors, and the like.

The present disclosure provides a display apparatus for avoiding the data lines being overcharged.

FIG. 1 shows an embodiment of a display apparatus (display apparatus 1). The display apparatus 1 defines a display region 101 and a non-display region 103 surrounding the display region 101. The display region 101 includes a number of scan lines $S_1$-$S_n$ and a number of data lines $D_1$-$D_m$. In one embodiment, the n and the m are positive integers. The scan lines $S_1$-$S_n$ are parallel with each other along a first direction X, and the data lines $D_1$-$D_m$ are parallel with each other along a second direction Y, the second direction Y being perpendicular to the first direction X. The scan lines $S_1$-$S_n$ are insulated from and intersect the data lines $D_1$-$D_m$ to define a number of pixel units 20 in a matrix. In other embodiments, the second direction Y can intersect with the first direction X in a different angle.

The display apparatus 1 includes a data driving circuit 100, a scan driving circuit 200, and a time controller 300, which are disposed in the non-display region 103. Each data line $D_m$ is electrically connected between the data driving circuit 100 and the pixel units 20 in one column. Each scan line $S_i$ is electrically connected between the scan driving circuit 200 and the pixel units 20 in one line. The time controller 300 is electrically connected to the data driving circuit 100 and the scan driving circuit 200. The time controller 300 generates control signals. The control signals may include synchronization signals, such as a vertical synchronization (Vsync) signal, a horizontal synchronization (Hsync) signal, a data enable (DE) signal, and non-synchronization signals. In one embodiment, the time controller 300 generates a first clock signal CLK and a second clock signal MCLK to the data driving circuit 100. The data driving circuit 100 converts digital signals into driving voltages and provides the driving voltages to the pixels 20 through the data lines $D_1$-$D_m$ for displaying images. The scan driving circuit 200 provides scan signals to the scan lines $S_1$-$S_n$ for scanning the pixels 20.

Figure 2:
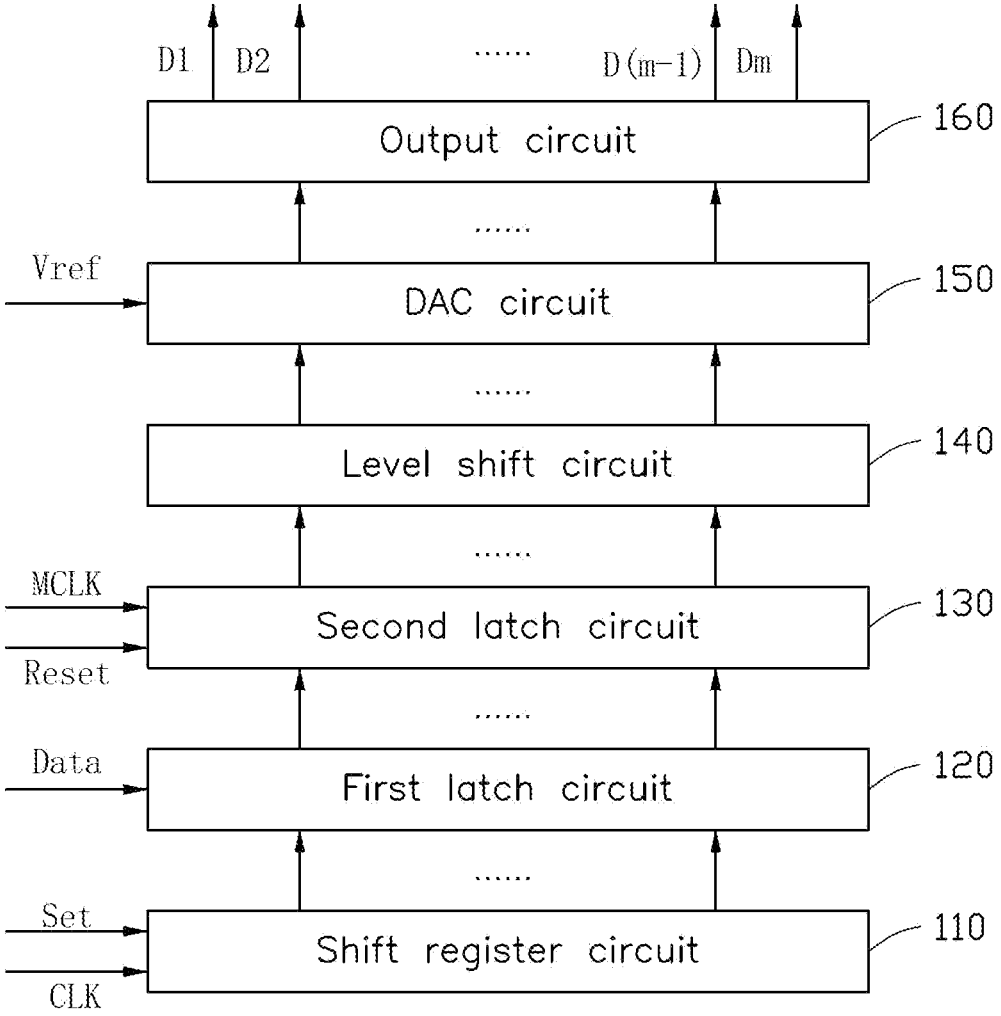
FIG. 2 is a diagram illustrating an embodiment of the data driving circuit of the apparatus of FIG. 1.

FIG. 2 shows the data driving circuit 100. The data driving circuit 100 includes a shift register circuit 110, a first latch circuit 120, a second latch circuit 130, a level shift circuit 140, a digital-to-analog circuit (DAC 150), and an output circuit 160.

The shift register circuit 110 receivers a set signal SET and the first clock signal CLK from the time controller 300, and generates a sampling pulse signal.

The first latch circuit 120 is electrically connected to the shift register circuit 110. The first latch circuit 120 receives digital signals Data from the time controller 300 and the sampling pulse signal from the shift register circuit 110. The first latch circuit 120 samples the digital signals Data based on the sampling pulse signal to generate sampled signals Sample.

The second latch circuit 120 is electrically connected to the first latch circuit 120 and the time controller 300. The second latch circuit 130 receives a reset signal and the second clock signal MCLK from the time controller 300. The second latch circuit 130 latches the sampled signals Sample based on the reset signal and the second clock signal MCLK. The second latch circuit 130 further detects a most significant bit (MSB) of a sampled signal corresponding to a current data line $D_k$, and detects whether the current data line $D_k$ is within a specified range. The second latch circuit 130 further controls a pre-operation in relation to the current data line $D_k$ based on the above detection. In one embodiment, $0<k<m$. The pre-operation is a pre-charge or a pre-discharge of the current data line $D_k$ to arrive at a specified voltage Veq before the driving voltage is provided to the current data line $D_k$.

Figure 3:
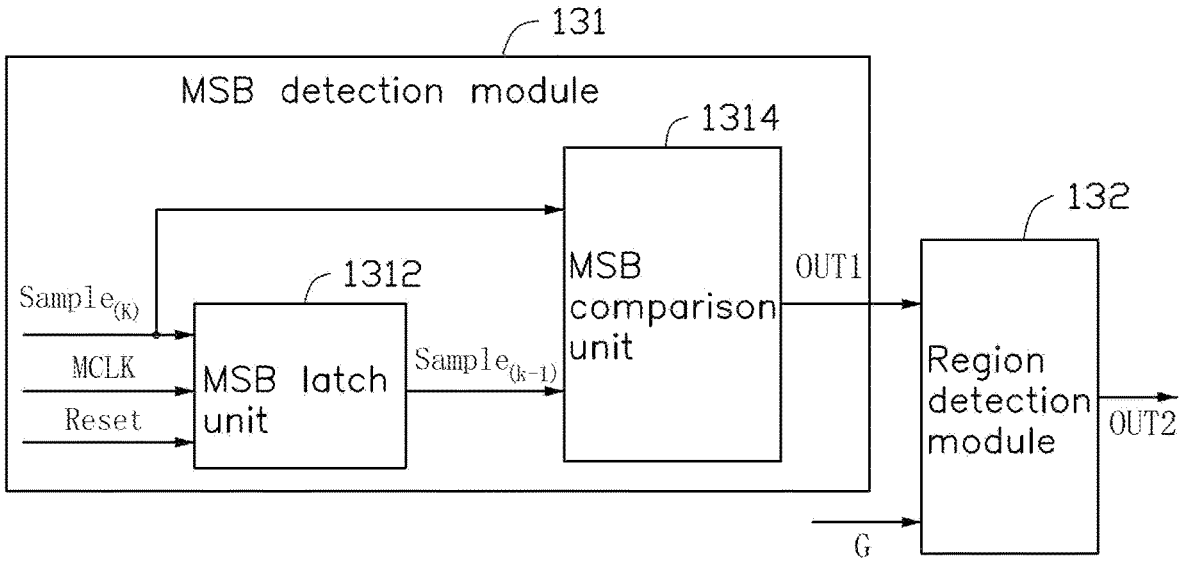
FIG. 3 is a diagram illustrating an embodiment of the second latch of the circuit of FIG. 2.

FIG. 3 shows the second latch circuit 130. The second latch circuit 130 includes an MSB detection module 131 and a region detection module 132.

The MSB detection module 131 detects a change in the MSB of the current sampled signal $Sample_{(k)}$ by comparing the previous sampled signal $Sample_{(k-1)}$, and outputs a signal through a first output terminal OUT1 depending on whether the MSB is changed or not changed. When the MSB of the current sampled signal $Sample_{(k)}$ is changed, the first output terminal OUT1 generates an effective signal, which is used for controlling the current data line $D_k$ to execute the pre-operation. When the MSB of the current sampled signal $Sample_{(k)}$ is unchanged, the first output terminal OUT1 generates an invalid signal, which controls the current data line $D_k$ to disable any pre-operation. In one embodiment, the effective signal from first output terminal OUT1 is a high level voltage signal, and the invalid signal is a low level voltage signal.

The MSB detection module 131 includes a MSB latch unit 1312 and an MSB comparison unit 1314.

The MSB latch unit 1312 receives the second clock signal MCLK, the reset signal Reset, and the sampled signal $Sample_{(k)}$ of the current data line $D_k$. The MSB latch unit 1312 latches the sampled signal $Sample_{(k-1)}$ of the previous data line $D_{(k-1)}$ and outputs the latched previous sampled signal $Sample_{(k-1)}$ of the current data line $D_{(k-1)}$ to the MSB comparison unit 1314 based on the second clock signal MCLK, the reset signal Reset, and the received the sampled signal $Sample_{(k)}$ of the current data line $D_k$.

The MSB comparison unit 1314 is electrically connected to the MSB latch unit 1312 and the region detection module 132. The MSB comparison unit 1314 compares the MSB of the sampled signal $Sample_{(k)}$ of the current data line $D_k$ and the MSB of the sampled signal $Sample_{(k-1)}$ of the previous data line $D_{(k-1)}$ and outputs a signal to the region detection module 132 through the first output terminal OUT1. When the MSB of the sampled signal $Sample_{(k)}$ is different from the MSB of the sampled signal $Sample_{(k-1)}$, the MSB comparison unit 1314 outputs an effective signal to the region detection module 132 through the first output terminal OUT1. If the MSB of the sampled signal $Sample_{(k)}$ is unchanged from the MSB of the sampled signal $Sample_{(k-1)}$, the MSB comparison unit 1314 outputs an invalid signal to the region detection module 132 through the first output terminal OUT1.

The region detection module 132 is electrically connected to the MSB comparison unit 1314. When the first output terminal OUT1 outputs the invalid signal, the region detection module 132 outputs the invalid signal through the second output terminal OUT2. When the first output terminal OUT1 outputs the effective signal, the region detection module 132 further detects whether a grayscale value corresponding to the data line $D_k$ is within the specified range. In one embodiment, the specified range is a specified grayscale value range. In one embodiment, when the digital signal of the display apparatus 1 is an 8-bits digital signal, the specified grayscale value range is from 112 to 143. In other embodiments, the specified grayscale value range is from 96 to 143. In other embodiment, the specified grayscale value range can be adjusted based on the number of bits of the digital signal. When the grayscale value corresponding to the data line $D_k$ is in the specified range, the signal generated by the MSB detection module 131 is shielded, and the second output terminal OUT2 of the region detection module 132 outputs the invalid signal. When grayscale value corresponding to the data line $D_k$ is out of the specified range, the MSB detection result of the MSB detection module 131 is enabled, and the second output terminal OUT2 outputs the signal based on the signal outputted by the first output terminal OUT1.

The level shift circuit 140 is electrically connected to the second latch circuit 130. The level shift circuit 140 modulates an amplitude of the sampled signal $Sample_{(k)}$.

The DAC circuit 150 is electrically connected to the level shift circuit 140. The DAC circuit 150 receives a reference voltage and converts the modulated and sampled signal $Sample_{(k)}$ into a driving voltage.

The output circuit 160 is electrically connected to the DAC circuit 150 and the data lines $D_1$-$D_m$. The output circuit 160 outputs the converted driving voltage to the data line $D_k$.

Figure 4:
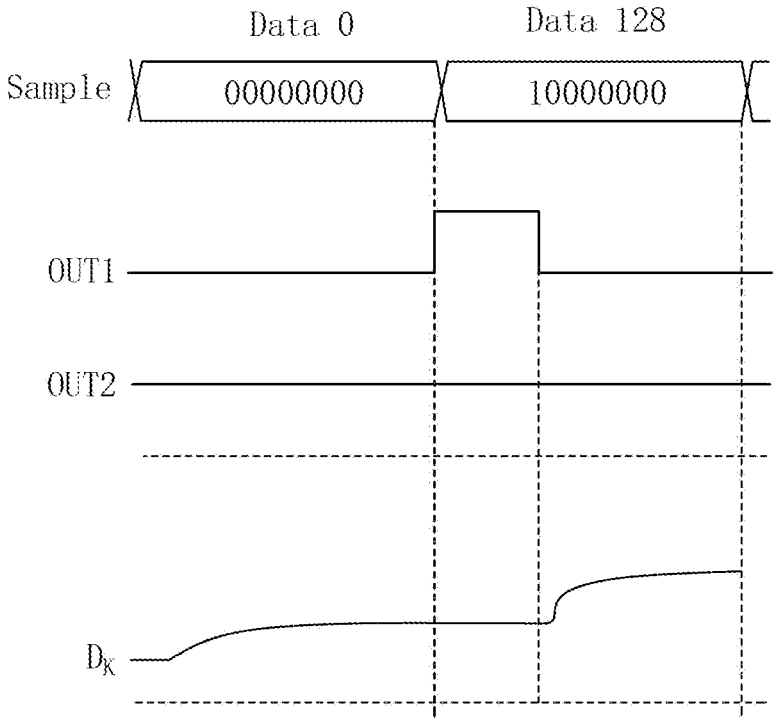
FIG. 4 is a timing chart showing a first embodiment of waveforms of the signal of a sampled signal, and the respective signals of a first output terminal, a second output terminal, and the data line.

FIG. 4 shows a timing chart of waveforms of the signal of the sampled signal $Sample_{(k)}$ in a first embodiment, and the signals of the first output terminal OUT1, the second output terminal OUT2, and of the data line $D_k$.

The sampled signal $Sample_{(k-1)}$ of the previous data line $D_{(k-1)}$ latched by the MSB latch unit 1312 is 00000000, when the sampled signal $Sample_{(k)}$ 10000000 of the current data line $D_k$ is received. The MSB latch unit 1312 outputs the latched previous sampled signal $Sample_{(k-1)}$ of the previous data line $D_{(k-1)}$ to the MSB comparison unit 1314 based on the second clock signal MCLK and the reset signal Reset. The MSB of the sampled signal $Sample_{(k)}$ of the current data line $D_k$ is different from the MSB of the sampled signal $Sample_{(k-1)}$ of the previous data line $D_{(k-1)}$, and the MSB comparison unit 1314 outputs the effective signal to the region detection module 132 through the first output terminal OUT1. When the grayscale value corresponding to the current data line $D_k$ is 128, within the specified grayscale value range, the effective signal outputted by the MSB detection module is shielded, and the region detection module 132 outputs the invalid signal through the second output terminal OUT2. Thereby, the pre-charging operation of the current data line $D_k$ is disabled.

Figure 5:
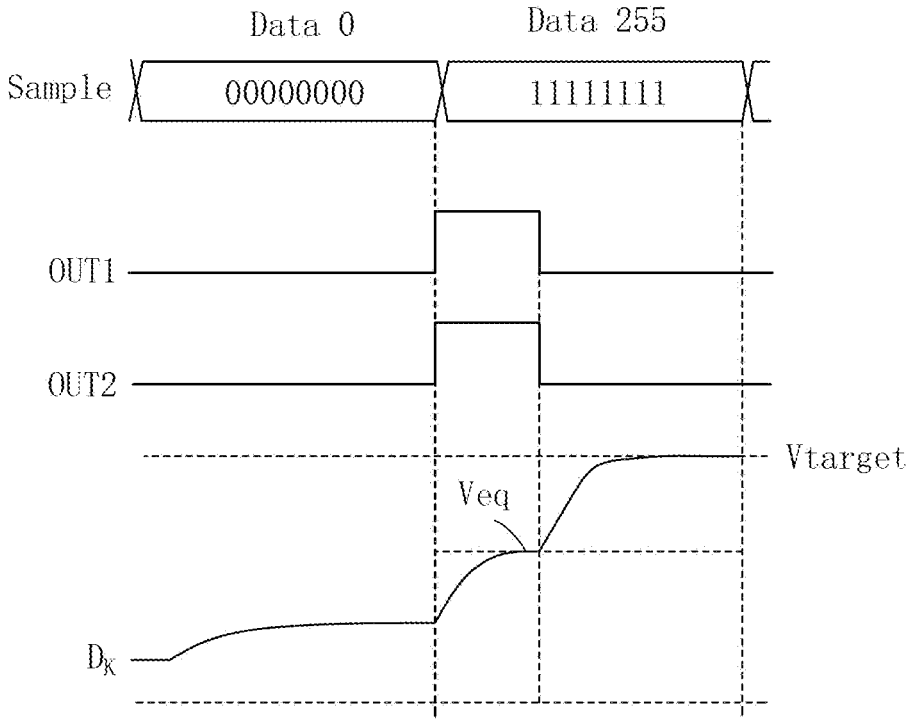
FIG. 5 is a timing chart showing a second embodiment of waveforms of the signal of the sampled signal, and the respective signals of the first output terminal, the second output terminal, and the data line.

FIG. 5 shows a timing chart showing waveforms of the signal of the sampled signal $Sample_{(k)}$ in a second embodiment, and the signals of the first output terminal OUT1, the second output terminal OUT2, and the corresponding data line $D_k$.

The sampled signal $Sample_{(k-1)}$ of the previous data line $D_{(k-1)}$ latched by the MSB latch unit 1312 is 00000000, when the sampled signal $Sample_{(k)}$ of 11111111 on the current data line $D_k$ is received. The MSB latch unit 1312 outputs the latched previous sampled signal $Sample_{(k-1)}$ of the previous data line $D_{(k-1)}$ to the MSB comparison unit 1314 based on the second clock signal MCLK and the reset signal Reset. The MSB of the sampled signal $Sample_{(k)}$ of the current data line $D_k$ is different from the MSB of the sampled signal $Sample_{(k-1)}$ of the previous data line $D_{(k-1)}$, and the MSB comparison unit 1314 outputs the effective signal to the region detection module 132 through the first output terminal OUT1. When the grayscale value corresponding to the current data line $D_k$ is 255, out of the specified grayscale value range, the region detection module 132 outputs the effective signal through the second output terminal OUT2. The voltage of current data line $D_k$ is thereby pre-charged to the specified voltage Veq.

Figure 6:
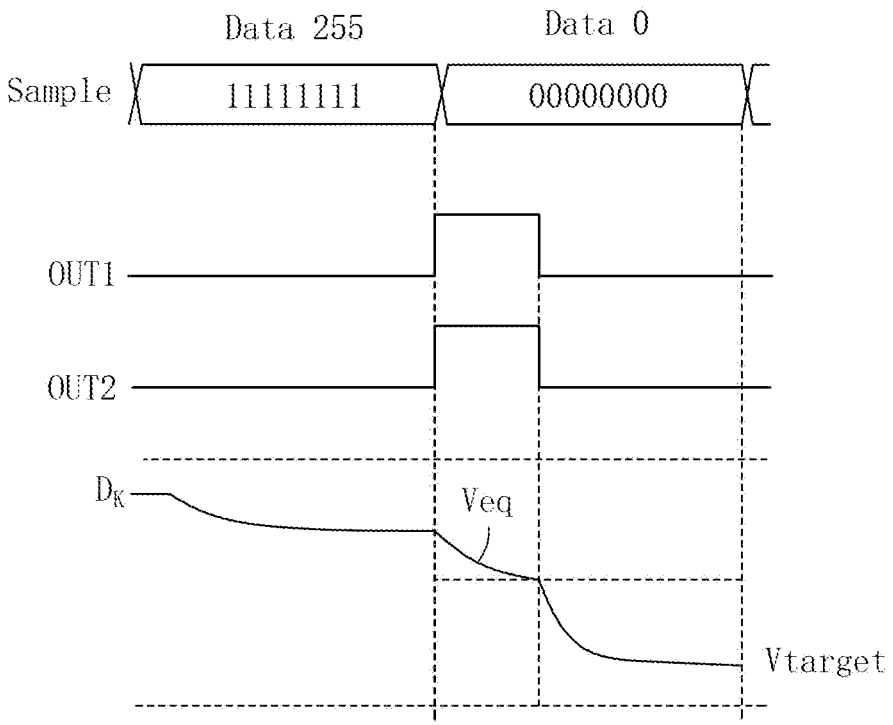
FIG. 6 is a timing chart showing a third embodiment of waveforms of the signal of the sampled signal, and the respective signals of the first output terminal, the second output terminal, and the data line.

FIG. 6 shows a timing chart of waveforms of the signal of the sampled signal $Sample_{(k)}$ in a third embodiment, and the signals of the first output terminal OUT1, the second output terminal OUT2, and the corresponding data line $D_k$.

The sampled signal $Sample_{(k-1)}$ of the previous data line $D_{(k-1)}$ latched by the MSB latch unit 1312 is 11111111, when the sampled signal $Sample_{(k)}$ of 00000000 of the current data line $D_k$ is received. The MSB latch unit 1312 outputs the latched previous sampled signal $Sample_{(k-1)}$ of the previous data line $D_{(k-1)}$ to the MSB comparison unit 1314 based on the second clock signal MCLK and the reset signal Reset. The MSB of the sampled signal $Sample_{(k)}$ of the current data line $D_k$ is different from the MSB of the sampled signal $Sample_{(k-1)}$ of the previous data line $D_{(k-1)}$, thus the MSB comparison unit 1314 outputs the effective signal to the region detection module 132 through the first output terminal OUT1. When the grayscale value corresponding to the current data line $D_k$ is 0, out of the specified grayscale value range, the region detection module 132 outputs the effective signal through the second output terminal OUT2. Thus, the voltage of current data line $D_k$ is pre-charged to the specified voltage Veq.

Based on the data driving circuit 100 in the display apparatus 1, the region detection module 132 detects the grayscale value corresponding to the current data line $D_k$. When the grayscale value corresponding to the current data line $D_k$ is within the specified range and the MSB of the sampled signal $Sample_{(k)}$ of the current data line $D_k$ is changed, the region detection module 132 outputs the invalid signal, and the pre-operation of the current data line $D_k$ is disabled. An over-voltage of the data line $D_k$ is avoided, and a performance of the display apparatus 1 is improved. Meanwhile, when the grayscale value corresponding to the current data line $D_k$ is out of the specified grayscale value range and the MSB of the sampled signal $Sample_{(k)}$ of the current data line $D_k$ is changed, the region detection module 132 outputs the effective signal, and the pre-operation of the current data line $D_k$ is executed to save some power consumption of the display apparatus 1.

While various and preferred embodiments have been described the disclosure is not limited thereto. On the contrary, various modifications and similar arrangements (as would be apparent to those skilled in the art) are also intended to be covered. Therefore, the scope of the appended claims should be accorded the broadest interpretation so as to encompass all such modifications and similar arrangements.

What is claimed is:

1. A data driving circuit configured for converting digital signals into driving voltages to the data lines, the data driving circuit comprising:

a shift register circuit, configured to generate a sampling pulse signal based on a set signal and a first clock signal;

a first latch circuit, configured to electrically connect to the shift register circuit, and sample a digital signal to generate a sampled signal based on the sampling pulse signal;

a second latch circuit, configured to electrically connect to the shift register circuit, detect that whether a most significant bit (MSB) of the sampled signal is changed, and outputs a signal for controlling a pre-operation of a current data line;

a level shift circuit, configured to electrically connect to the second latch circuit, and modulate an amplitude of the sampled signal;

a DAC circuit, configured to electrically connect to the level shift circuit, and convert the modulated and sampled signal into driving voltage; and an output circuit, configured to electrically connect to the shift register circuit and the data lines, and provide the converted driving voltage to the current data line;

wherein the pre-operation is provided with a specified voltage to the current data line before the converted driving voltage is provided to the current data line;

wherein when the MSB of the sampled signal is changed, the second latch circuit outputs an effective signal, and the second latch circuit further detects whether the current data line is in a specified region;

wherein if the current data line is in a specified region, the second latch circuit outputs an invalid signal, and the pre-operation is disabled according to the invalid signal.

2. The data driving circuit of claim 1, wherein if the current data line is out of the specified region, the second latch outputs the effective signal outputted by the first latch circuit, and the pre-operation of the current data line is executed based on the effective signal.

3. The data driving circuit of claim 2, wherein the second latch circuit comprises a MSB detection module and a region detection module; the MSB detection module detects whether the MSB of the sampled signal corresponding to the current data line is change, and outputs the signal to the region detection module through a first output terminal; if the MSB of the sampled signal corresponding to the current data line is change, and outputs the effective signal to the region detection module through the first output terminal; the region detection module detects whether a grayscale value corresponding to the current data line is in the specified region; wherein if the grayscale value corresponding to the current data line is in the specified region, the signal generated by the MSB detection module is shielded, the region detection module outputs the invalid signal through a second output terminal; and if the grayscale value corresponding to the current data line is out of the specified region, the region detection module outputs the effective signal outputted by the MSB detection module through the second output terminal.

4. The data driving circuit of claim 3, wherein if the MSB of the sampled signal is unchanged, the first output terminal outputs the invalid signal, and the region detection module directly outputs the signal outputted by the MSB detection module through the second output terminal.

5. The data driving circuit of claim 3, wherein the MSB detection module comprises a MSB latch unit and a MSB comparison unit; the MSB latch unit latches the sampled signal of a pervious data line, and outputs the sampled signal of the pervious data line to the MSB comparison unit based on a reset signal and a second clock signal while receiving the sampled signal of the current data line; the MSB comparison unit compares the MSB of the sampled signal of the current data line and the MSB of the sampled signal of the previous data line, and outputs a signal to the region detection module through the first output terminal; wherein if the MSB of the sampled signal of the current data line is different from the MSB of the sampled signal of the previous data line, the MSB comparison unit outputs the effective signal through the first output terminal; and if the MSB of the sampled signal of the current data line is unchanged from the MSB of the sampled signal of the previous data line, the MSB comparison unit outputs the invalid signal through the first output terminal.

6. The data driving circuit of claim 1, wherein the specified region is a specified grayscale value range.

7. The data driving circuit of claim 6, wherein the specified grayscale value range is from 112 to 143.

8. A display apparatus comprises a plurality of scan lines and a plurality of data lines; a plurality of pixels are defined by the plurality of scan lines and the plurality of scan lines; the display apparatus further comprises a data driving circuit for converting digital signals into driving voltages, a scan driving circuit for providing scan signals to the plurality of scan lines, and a time controller for providing clock signals; the data driving circuit comprising:

a shift register circuit, configured to generate a sampling pulse signal based on a set signal and a first clock signal;

a first latch circuit, configured to electrically connect to the shift register circuit, and sample digital signal to generate a sampled signal based on the sampling pulse signal;

a second latch circuit, configured to electrically connect to the shift register circuit, detect that whether a MSB of the sampled signal is changed, and outputs a signal for controlling a pre-operation of a current data line;

a level shift circuit, configured to electrically connect to the second latch circuit, and modulate an amplitude of the sampled signal;

a DAC circuit, configured to electrically connect to the level shift circuit, and convert the modulated and sampled signal into driving voltage; and an output circuit, configured to electrically connect to the shift register circuit and the data lines, and provide the converted driving voltage to the current data line;

wherein the pre-operation is provided with a specified voltage to the current data line before the converted driving voltage is provided to the current data line;

wherein when the MSB of the sampled signal is changed, the second latch circuit outputs an effective signal, and the second latch circuit further detects whether the current data line is in a specified region, wherein if the current data line is in a specified region, the second latch circuit outputs an invalid signal, and the pre-operation is disabled according to the invalid signal.

9. The display apparatus of claim 8, wherein if the current data line is out of the specified region, the second latch outputs the effective signal outputted by the first latch circuit, and the pre-operation of the current data line is executed based on the effective signal.

10. The display apparatus of claim 9, wherein the second latch circuit comprises a MSB detection module and a region detection module; the MSB detection module detects whether the MSB of the sampled signal corresponding to the current data line is change, and outputs the signal to the region detection module through a first output terminal, wherein if the MSB of the sampled signal corresponding to the current data line is change, and outputs the effective signal to the region detection module through the first output terminal; the region detection module detects whether a grayscale value corresponding to the current data line is in the specified region, wherein if the grayscale value corresponding to the current data line is in the specified region, the signal generated by the MSB detection module is shielded, the region detection module outputs the invalid signal through a second output terminal; and if the grayscale value corresponding to the current data line is out of the specified region, the region detection module outputs the effective signal outputted by the MSB detection module through the second output terminal.

11. The display apparatus of claim 10, wherein when the MSB of the sampled signal is unchanged, the first output terminal outputs the invalid signal, and the region detection module directly outputs the signal outputted by the MSB detection module through the second output terminal.

12. The display apparatus of claim 10, wherein the MSB detection module comprises a MSB latch unit and a MSB comparison unit; the MSB latch unit latches the sampled signal of a pervious data line, and outputs the sampled signal of the pervious data line to the MSB comparison unit based on a reset signal and a second clock signal while receiving the sampled signal of the current data line; the MSB comparison unit compares a MSB of the sampled signal of the current data line and the MSB of the sampled signal of the previous data line, and outputs a signal to the region detection module through the first output terminal, wherein if the MSB of the sampled signal of the current data line is different from the MSB of the sampled signal of the previous data line, the MSB comparison unit outputs the effective signal through the first output terminal, and if the MSB of the sampled signal of the current data line is unchanged from the MSB of the sampled signal of the previous data line, the MSB comparison unit outputs the invalid signal through the first output terminal.

13. The display apparatus of claim 8, wherein the specified region is a specified grayscale value range.

14. The display apparatus of claim 13, wherein the specified grayscale value range is from 112 to 143.

* * * * *